US007377136B1

(12) United States Patent
DeMartinis et al.

(10) Patent No.: US 7,377,136 B1
(45) Date of Patent: May 27, 2008

(54) COMPUTER SECURITY HOOK SYSTEM WITH CORRESPONDING PEGS, HOLES AND RINGS

(76) Inventors: Germain DeMartinis, 10631 Yolanda Ave., Northridge, CA (US) 91326; Douglas Toby Brown, 8309 Mesa Rd., Santee, CA (US) 92071

( * ) Notice: Subject to any disclaimer, the term of this patent is extended or adjusted under 35 U.S.C. 154(b) by 56 days.

(21) Appl. No.: 11/530,727

(22) Filed: Sep. 11, 2006

Related U.S. Application Data

(60) Provisional application No. 60/715,652, filed on Sep. 9, 2005.

(51) Int. Cl.
*E05B 73/00* (2006.01)

(52) U.S. Cl. ..... 70/14; 70/58

(58) Field of Classification Search ..... 70/14, 70/18, 57, 58, 164, 423, 424, 426–428; 248/551–553
See application file for complete search history.

(56) References Cited

U.S. PATENT DOCUMENTS 934,928 A * 9/1909 Michel ..... 70/423
5,394,713 A * 3/1995 Harmon ..... 70/58
5,787,739 A * 8/1998 Derman ..... 70/58
5,875,657 A * 3/1999 Kelley ..... 70/18
5,907,962 A * 6/1999 Smithson et al. ..... 70/58
6,038,891 A * 3/2000 Zeren et al. ..... 70/58
6,105,922 A * 8/2000 Derman ..... 248/551
6,301,940 B1 * 10/2001 Derman et al. ..... 70/58
6,389,854 B1 * 5/2002 Huang ..... 70/58
6,449,992 B1 * 9/2002 Yu et al. ..... 70/58
6,662,602 B1 * 12/2003 Carl ..... 70/58
6,691,537 B2 * 2/2004 Tan ..... 70/58
7,294,032 B1 * 11/2007 Ventura ..... 441/75

* cited by examiner

*Primary Examiner*—Lloyd A. Gall
(74) *Attorney, Agent, or Firm*—Lewis and Roca, LLP

(57) ABSTRACT

A computer lock is comprising: a first locking member having a top end, a bottom end opposite the top end, an inner surface between the top end and the bottom end, and an outer surface opposite the inner surface and between the top end and the bottom end; and a second locking member having a top end, a bottom end opposite the top end, an inner surface between the top end and the bottom end, and an outer surface opposite the inner surface and between the top end and the bottom end, wherein the first locking member and the second locking member each comprise a hook disposed at the bottom end, a ring disposed at the top end, and a corresponding peg and a hole disposed on the inner surface between the top end and the bottom end.

12 Claims, 2 Drawing Sheets

COMPUTER SECURITY HOOK SYSTEM WITH CORRESPONDING PEGS, HOLES AND RINGS

CROSS-REFERENCE TO RELATED APPLICATIONS

This application claims priority to U.S. Provisional Application Ser. No. 60/715,652, filed Sep. 9, 2005, which is hereby incorporated by reference as if set forth herein.

SUMMARY

The present invention relates to a computer lock system. More particularly, the present invention relates to a computer lock system having two components with corresponding pegs, holes and rings.

In one aspect of the present invention, a computer lock is provided comprising: a first locking member having a top end, a bottom end opposite the top end, an inner surface between the top end and the bottom end, and an outer surface opposite the inner surface and between the top end and the bottom end; and a second locking member having a top end, a bottom end opposite the top end, an inner surface between the top end and the bottom end, and an outer surface opposite the inner surface and between the top end and the bottom end, wherein the first locking member and the second locking member each comprise a hook disposed at the bottom end, a ring disposed at the top end, and a corresponding peg and a hole disposed on the inner surface between the top end and the bottom end, the peg on the first locking member configured to fit securely in the hole on the second locking member and the peg on the second locking member configured to fit securely in the hole on the first locking member when the inner surface of the first locking member and the inner surface of the second locking member are pressed together.

DETAILED DESCRIPTION

Figure 1:
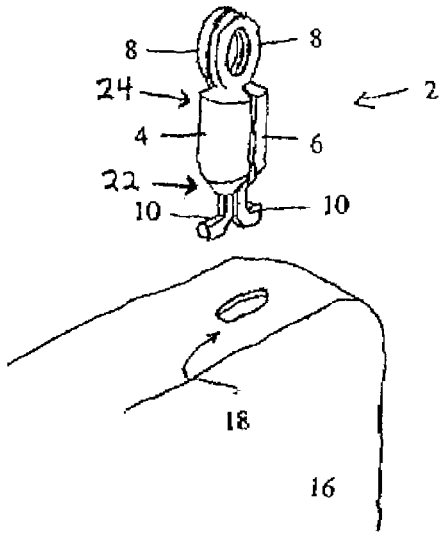
FIG. 1 is a perspective view of an exemplary computer lock system according to the present invention.

Persons of ordinary skill in the art will realize that the following disclosure is illustrative only and not in any way limiting. Other embodiments of the invention will readily suggest themselves to such skilled persons having the benefit of this disclosure.

The present invention is a lock for protecting equipment, such as a computer, against theft. FIGS. 1-7 illustrate lock 2, with like components numbered alike.

Lock 2 comprises first locking member 4 and second locking member 6. First locking member 4 and second locking member 6 each include a primary body having ring 8, hook 10, peg 12, and hole 14. First locking member 4 and second locking member 6 are preferably identical. They may be coupled or mated with one another in order to fix into a defined space, such as security slot 18, on a piece of equipment, such as computer 16, thereby providing a mechanism for attaching a cable or other securing means (not shown) to the piece of equipment. First and second locking members 4 and 6 are preferably formed from metal. However, it is contemplated that first and second locking members 4 and 6 may be formed from any material strong enough to provide a secure and tamper-proof lock.

Figure 7:
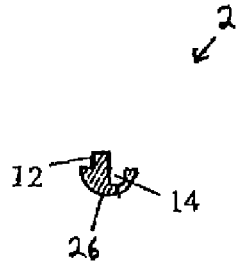
FIG. 7 is a cross-sectional plan view of the exemplary locking member of FIG. 5B.

The primary body of first locking member 4 and second locking member 6 comprises inner surface 20 positioned between bottom end 22 and top end 24. In a preferred embodiment, bottom end 22 and top end 24 are spaced about 14.0 millimeters apart. As seen in FIGS. 2-5A, inner surface 20 is preferably a substantially planar, or flat, surface, with the exception of peg 12 and hole 14. This planar surface allows inner surface 20 of first locking member 4 and inner surface 20 of second locking member 6 to be pressed close to one another without any significant obstacles. The primary body of first locking member 4 and second locking member 6 also comprises outer surface 26 positioned opposite inner surface 20 and between bottom end 22 and top end 24. In a preferred embodiment, outer surface 26 is substantially convex in shape. For example, outer surface 26 may be substantially semi-circular, as seen in FIG. 7. However, the shape of outer surface 26 may vary.

The primary body of first locking member 4 and second locking member 6 also comprises first side 28, positioned adjacent and between both inner surface 20 and outer surface 26, and second side 30, positioned adjacent and between both inner surface 20 and outer surface 26 and opposite first side 28. In a preferred embodiment, first side 28 and second side 30 are spaced about 10.0 millimeters apart.

Bottom end 22 comprises a fixed hook 10 projecting outward from the primary body. In a preferred embodiment, the end of hook 10 extends away from inner surface 20 in a position substantially perpendicular to the plane of inner surface 20, such as in FIG. 5A.

Figure 4A:
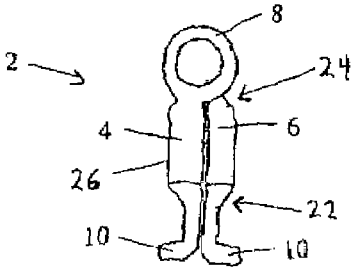
FIG. 4A is a side view of a completed exemplary computer lock system according to the present invention.
Figure 5A:
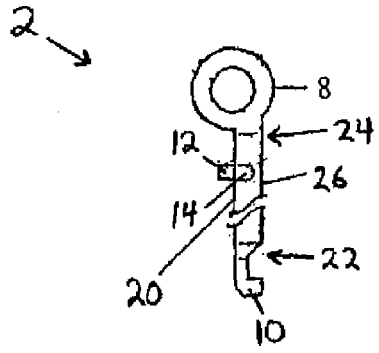
FIG. 5A is a side view of an exemplary locking member according to the present invention.
Figure 5B:
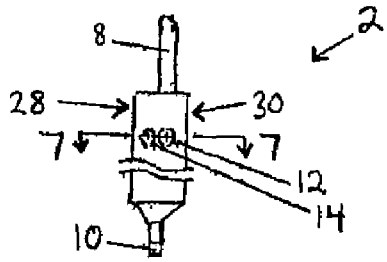
FIG. 5B is another side view of the exemplary locking member of FIG. 5A.
Figure 6:
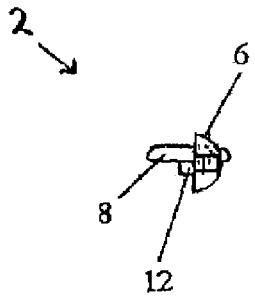
FIG. 6 is a plan view of the exemplary locking member of FIG. 5A.

Hook 10 may have an elongated neck in between the end of hook 10 and bottom end 22. The elongated neck preferably extends down and away from bottom end 22 in a direction substantially parallel to the plane of inner surface 20 and is at least about 4.5 mm long. This elongated neck makes lock 2 universally compatible. Similar devices have a shorter hook neck, and are therefore compatible with a considerably smaller range of equipment. As seen in FIGS. 4A and 5A, the bottom of hook 10 may be substantially perpendicular to the elongated neck of hook 10, thereby providing a hook that may conveniently be inserted into security slot 18, yet still provide enough resistance against being removed. In a preferred embodiment, the end of hook 10 has a height of about 3.0 millimeters, a width of about 2.7 millimeters, and extends about 2.3 millimeters away from the elongated neck.

In a preferred embodiment, hook 10 is connected to bottom end 22 about halfway between first side 28 and second side 30. However, it is contemplated that hook 10 may be positioned in a variety of different locations and extend in a variety of different directions so long as the hook on first locking member 4 and the hook on second locking member 6 extend in opposite directions when locking members 4 and 6 are mated together.

Top end 24 comprises ring 8 projecting outward from the primary body. In a preferred embodiment, ring 8 is set off-center between first side 28 and second side 30, with the ring's center being closer to inner surface 20 than outer surface 26, thereby enabling the ring on a corresponding locking member to be aligned side by side with ring 8. This positioning allows a cable or other securing means, such as a padlock, to pass through both rings when the locking members are engaged. In a preferred embodiment, the plane of ring 8 is substantially parallel to the plane of hook 10 and substantially perpendicular to the plane of inner surface 20. However, it is contemplated that the plane of ring 8 may be oriented in any direction so long as the opening in ring 8 may be aligned with the opening in another ring on a corresponding locking member when the two locking members are engaged. In an exemplary embodiment, ring 8 has an inner diameter of about 8.4 millimeters and an outer diameter of about 14.0 millimeters, with its center being spaced about 5.0 millimeters from outer surface 26.

The mid-section of the primary body, in between bottom end 22 and top end 24, comprises peg 12 and hole 14. Peg 12 protrudes from inner surface 20, while a corresponding hole, or opening, 14 is formed within inner surface 20. This corresponding relationship between peg 12 and hole 14 is further reflected in FIG. 7, which shows a cross-sectional plan view of the exemplary lock 2 of FIG. 5B. In this fashion, peg 12 fits into and mates with hole 14 located on a separate corresponding locking member when the two locking members are engaged. Peg 12 and hole 14 may comprise any shape so long as peg 12 fits securely into hole 14. For example, peg 12 and hole 14 may be formed in the shape of a circle, triangle, rectangle, pentagon, and practically any other polygon known in the art. In a preferred embodiment, peg 12 and hole 14 are about equal in size, with only about a fraction of a millimeter difference in diameter. For example, peg 12 may be about 3.0 millimeters in diameter, while corresponding hole 14 may be about 3.3 millimeters in diameter. Additionally, in an exemplary embodiment, peg 12 extends about 3.0 millimeters away from inner surface 20, while hole 14 extends about 3.1 millimeters into inner surface 20. However, it is contemplated that a variety of different size arrangements may be employed so long as peg 12 can fit securely into hole 14.

Figure 2:
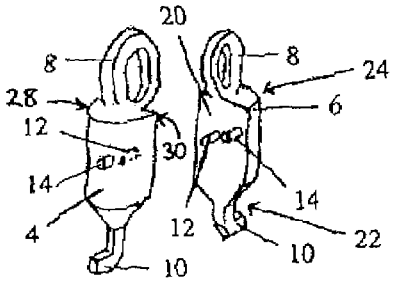
FIG. 2 is an exploded perspective view of an exemplary computer lock system according to the present invention.
Figure 4B:
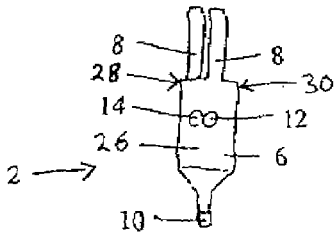
FIG. 4B is another side view of a completed exemplary computer lock system according to the present invention.

Preferably, each of peg 12 and hole 14 are set slightly off-center so that they may be placed to the side of one another, as in FIGS. 2, 4B and 7. Additionally, in an exemplary embodiment, both peg 12 and hole 14 are disposed about halfway between bottom end 22 and top end 24. However, it is contemplated that peg 12 and hole 14 may be positioned in variety of different locations on inner surface 20, both with respect to one another and with respect to bottom end 22 and top end 24.

The peg and hole design of the primary body strengthens lock 2 so that it cannot be twisted, opened and ultimately removed from its fixed position once a securing means, such as a cable or padlock, has linked the two locking members together. Similar devices do not contain such a peg and hole design and can be twisted open. This peg and hole design serves to strengthen the overall security and usefulness of the invention.

Figure 3:
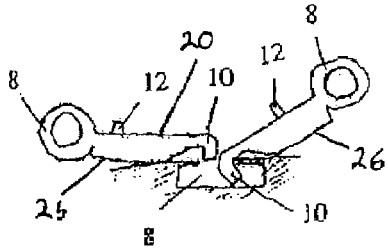
FIG. 3 is a side view of an exemplary computer lock system according to the present invention being placed on a computer.

FIG. 3 illustrates lock 2 being inserted into security slot 18 on computer 16. Hook 10 on each locking member is shaped to fit into a defined space, such as security slot 18, and remain fixed in the defined space when coupled with an identical locking member placed in the opposite direction. The two locking members are tilted apart, and then one is installed after the other. When the two hooks of the two locking members are placed into security slot 18 and inner surfaces 20 of both locking members are matched and pressed together, pegs 12 and holes 14 of both locking members line up and mated with each other, such as seen in FIG. 4A.

Rings 8 of both locking members are thereby matched and aligned so that a securing means, such as a cable or a padlock, may then be passed through rings 8 to lock hooks 10 of both locking members into security slot 18 or some other defined space. The securing means may then be anchored or otherwise secured to a stable object, thereby securing the equipment to the stable object.

A single locking member will not work alone. Two corresponding locking members must be used for proper operation. Each locking member is designed to mate and work with an identical locking member. This design serves to make production simpler, less costly, less time consuming, and make the end-user experience generally simpler and easier. Other devices use two or more different pieces that must be assembled like a puzzle. The present invention is easier to use and less expensive to manufacture than other devices in this field.

The dimensions provided in the examples above represent one embodiment of the present invention. It is contemplated that a variety of other measurements may be used as well in accordance with the present invention. Preferably, any adjustments will be made proportional to the dimensions provided.

Although the lock of the present invention has been shown in use with a computer, it is contemplated that it may be used for protecting many other types of equipment against theft as well.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings without departing from the essential scope thereof. Therefore, it is intended that the invention not be limited to the particular embodiment disclosed as the best mode contemplated for carrying out this invention.

What is claimed is:

1. A computer lock comprising:

a first locking member having a top end, a bottom end opposite said top end, an inner surface between said top end and said bottom end, and an outer surface opposite said inner surface and between said top end and said bottom end; and a second locking member having a top end, a bottom end opposite said top end, an inner surface between said top end and said bottom end, and an outer surface opposite said inner surface and between said top end and said bottom end, wherein said first locking member and said second locking member each comprise a hook disposed at said bottom end, a ring disposed at said top end, and a peg and a hole disposed on said inner surface between said top end and said bottom end, said peg on said first locking member configured to fit securely in said hole on said second locking member and said peg on said second locking member configured to fit securely in said hole on said first locking member when said inner surface of said first locking member and said inner surface of said second locking member are pressed together.

2. The computer lock of claim 1, wherein said first locking member and said second locking member are substantially identical in shape and positioning of said ring, said hook, said peg, and said hole.

3. The computer lock of claim 1, wherein said inner surface of said first locking member and said second locking member is substantially planar except for said peg and said hole.

4. The computer lock of claim 1, wherein said ring on said first locking member and said ring on said second locking member are connected to said top end in a position such that said rings are aligned when said inner surface of said first locking member and said inner surface of said second locking member are pressed together.

5. The computer lock of claim 4, wherein said first locking member and said second locking member each have a first side positioned adjacent to and between said inner surface and said outer surface and a second side opposite said first side and positioned adjacent to and between said inner surface and said outer surface, said ring on said first locking member and said ring on said second locking member connected to said top end at a position closer to said first side than said second side.

6. The computer lock of claim 5, wherein the plane of said ring on said first locking member and said second locking member is oriented in a position substantially perpendicular to the plane of said inner surface of the respective locking member.

7. The computer lock of claim 1, wherein the end of said hook on said first locking member and said second locking member extends away from said inner surface in a direction substantially perpendicular to the plane of said inner surface.

8. The computer lock of claim 1, wherein the bottom surface of said hook on said first locking member and said second locking member is substantially perpendicular to the plane of said inner surface.

9. The computer lock of claim 1, wherein said peg and said hole on said first locking member and said second locking member are positioned to the side of one another.

10. The computer lock of claim 1, wherein said peg and said hole on said first locking member and said second locking member are substantially circular in shape.

11. The computer lock of claim 1, wherein said outer surface of said first locking member and said second locking member is substantially convex in shape.

12. The computer lock of claim 1, wherein the diameter of said peg on said first locking member and the diameter of said hole on said second locking member are about equal in size, with only about a fraction of a millimeter difference between the two, and the diameter of said peg on said second locking member and the diameter of said hole on said first locking member are about equal in size, with only about a fraction of a millimeter difference between the two.

* * * * *